US011291264B2

(12) United States Patent
Erb et al.

(10) Patent No.: US 11,291,264 B2
(45) Date of Patent: Apr. 5, 2022

(54) FOOTBALL HELMET SHELL

(71) Applicant: Schutt Sports IP, LLC, Litchfield, IL (US)

(72) Inventors: Robert Erb, Plandome, NY (US); Louis Anthony Vanhoutin, Iuka, IL (US); Cortney Warmouth, Edwardsville, IL (US)

(73) Assignee: Schutt Sports IP, LLC, New York, NY (US)

( * ) Notice: Subject to any disclaimer, the term of this patent is extended or adjusted under 35 U.S.C. 154(b) by 201 days.

(21) Appl. No.: 16/369,389

(22) Filed: Mar. 29, 2019

(65) Prior Publication Data

US 2019/0223536 A1 Jul. 25, 2019

Related U.S. Application Data

(63) Continuation-in-part of application No. 15/456,279, filed on Mar. 10, 2017, now Pat. No. 10,258,098.

(60) Provisional application No. 62/320,174, filed on Apr. 8, 2016.

(51) Int. Cl.

| | |
|---|---|
| ***A42B 3/16*** | (2006.01) |
| ***A42B 3/12*** | (2006.01) |
| *A42B 3/20* | (2006.01) |

(52) U.S. Cl.

CPC ..... *A42B 3/16* (2013.01); *A42B 3/127* (2013.01); *A42B 3/20* (2013.01)

(58) Field of Classification Search

CPC ..... A42B 3/127; A42B 3/20; A42B 3/16

See application file for complete search history.

(56) References Cited

U.S. PATENT DOCUMENTS

| | | | | |
|---|---|---|---|---|
| 1,522,952 A * | 1/1925 | Goldsmith | ..... | A42B 3/00 2/414 |
| 1,559,252 A * | 10/1925 | Hartman | ..... | A42B 3/00 2/418 |
| 4,677,694 A | 7/1987 | Crow | | |
| D330,951 S | 11/1992 | Neustadt | | |
| 6,138,284 A | 10/2000 | Arai | | |

(Continued)

OTHER PUBLICATIONS

Picture of helmet worn by Don Maynard in web page titled Legendary Insights: Don Maynard Part 1, 2014.

(Continued)

*Primary Examiner* — Tajash D Patel

(74) *Attorney, Agent, or Firm* — Fish & Richardson P.C.

(57) ABSTRACT

A plastic football helmet has a shell with a left earflap in a left side region and a right earflap in a right side region, each ear flap having a non-circular ear hole, and an offset area defined on a top edge by a top banked portion and on a bottom edge by a bottom banked portion, the offset area extending continuously from the right ear flap, across the rear region, to the left ear flap. The non-circular ear holes are in the offset area. Both the top edge and the bottom edge of the offset area curve upward from the right ear flap to the rear region and curve upward from the left ear flap to the rear region. The top edge and bottom edge do not meet at any point such that offset area begins at an open right end in the right earflap and ends at an open left end in the left earflap. Cheek support are attached to the earflaps to improve retention of the helmet and provide protection to the cheek area against blows.

20 Claims, 10 Drawing Sheets

(56) References Cited

U.S. PATENT DOCUMENTS

| | | | | |
|---|---|---|---|---|
| D459,032 | S | 6/2002 | Gatellet | |
| D465,067 | S | 8/2002 | Ide | |
| 6,434,755 | B1 | 8/2002 | Halstea | |
| D466,651 | S * | 12/2002 | Halstead | D29/106 |
| 6,934,971 | B2 * | 8/2005 | Ide | A42B 3/08 2/425 |
| D512,534 | S | 12/2005 | Maddux | |
| D528,705 | S | 9/2006 | Ide | |
| 8,549,671 | B2 | 10/2013 | Sackett | |
| D704,899 | S * | 5/2014 | Erb | D29/122 |
| D753,346 | S | 4/2016 | Erb | |
| 9,314,063 | B2 * | 4/2016 | Bologna | A42B 3/062 |
| 9,398,783 | B2 | 7/2016 | Nimmons | |
| 9,681,697 | B2 | 6/2017 | Ikeda | |
| 9,743,702 | B2 | 8/2017 | Warmouth | |
| 2002/0174480 | A1 | 11/2002 | Lombard | |
| 2004/0025231 | A1 | 2/2004 | Ide | |
| 2011/0271428 | A1 * | 11/2011 | Withnall | A42B 3/20 2/422 |
| 2014/0223644 | A1 * | 8/2014 | Bologna | A42B 3/068 2/414 |
| 2015/0257471 | A1 | 9/2015 | Warmouth | |
| 2016/0157546 | A1 | 6/2016 | Princip | |
| 2017/0265557 | A1 | 9/2017 | Mercado, Jr. et al. | |

OTHER PUBLICATIONS

Picture of "Antique Football Helmet 1910's Era" in web page titled Vintage Football Helmets Antique Football Helmets.
Picture of Spalding No. 25 ear protector.
Rawlings catalog page showing Rawlings Improved Intercollegiate Helmet No. 4.
Picture of late 1910-1920's Dog-Ear Style Leather Football Helmet.
Picture of Horace Partridge Helmet.
Picture of Folsom Sporting Goods Helmet.
D&M Sports Goods Catalog, Fall & Winter 1926-27.
Picture of D&M Scholastic Helmet.

* cited by examiner

FOOTBALL HELMET SHELL

CROSS REFERENCE TO RELATED APPLICATIONS

This application is a continuation of U.S. patent application Ser. No. 15/456,279, filed Mar. 10, 2017, which claims the benefit of U.S. Provisional Application Ser. No. 62/320,174, filed Apr. 8, 2016. The entire contents of the above applications are hereby incorporated by reference herein.

FIELD AND BACKGROUND OF THE INVENTION

The subject technology relates to football helmets for protecting the heads of athletes from collisions sustained during sports play. Modern football helmets comprise a rigid plastic shell, padding systems removably attached to the inner surface of the shell, and a face guard and chin strap removably attached to the outer surface of the shell.

SUMMARY OF THE INVENTION

According to the subject technology, cheek supports in the form of extended cheek pads, as described herein, are attached to the shell of a football helmet to improve retention of the helmet on the wearer's head during collisions and provide further protection to the cheek area. Each cheek support is attached to an earflap of the helmet shell and comprises an inner plate and an outer brace connected together by fasteners passing through holes formed in the earflaps. The inner plate and outer brace have a lower contour which preferably conforms to the contour of the earflaps. The inner plate has an integral cheek extension which extends beyond the edge of the earflap to at least partially overlay the area of the zygomatic bone of the wearer's skull. Padding is removably attached to the inner surface of the inner plate.

According to another aspect of the subject technology, designs for helmet faceguards are disclosed, which may be used in the helmet of the technology in conjunction with cheek supports, or in other football helmets or helmets for other sports.

DETAILED DESCRIPTION

Figure 1A:
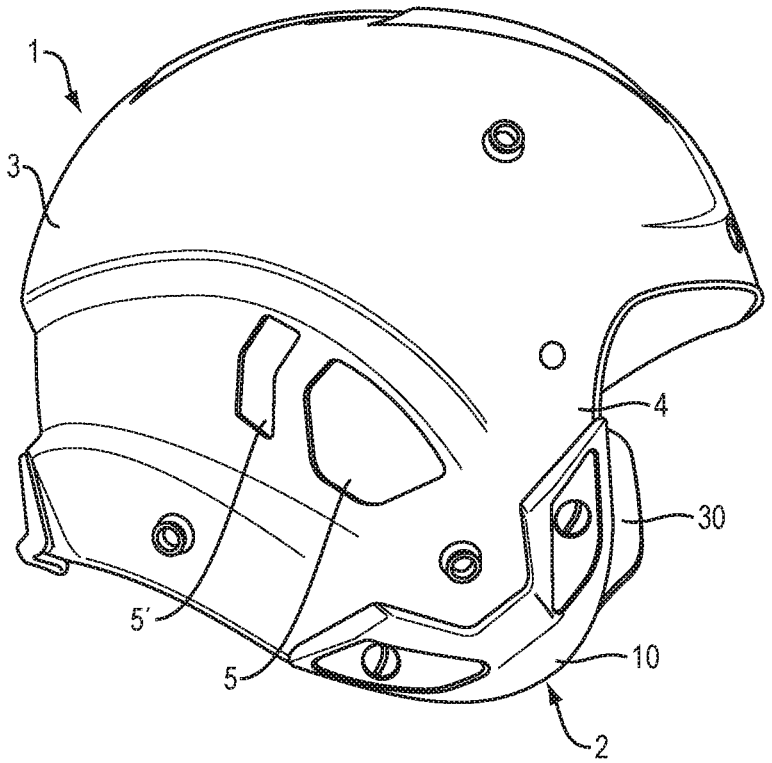
FIG. 1A is a right side view of a football helmet having cheek supports according to an embodiment of the subject technology.
Figure 1B:
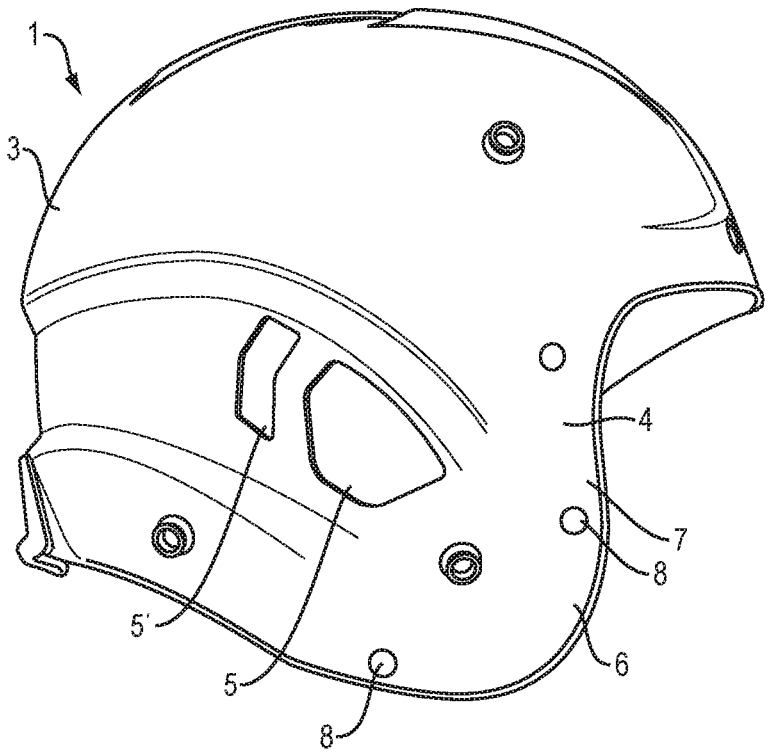
FIG. 1B is a right side view of a football helmet according to an embodiment of the subject technology with the cheek supports removed to show features of the earflap.
Figure 2:
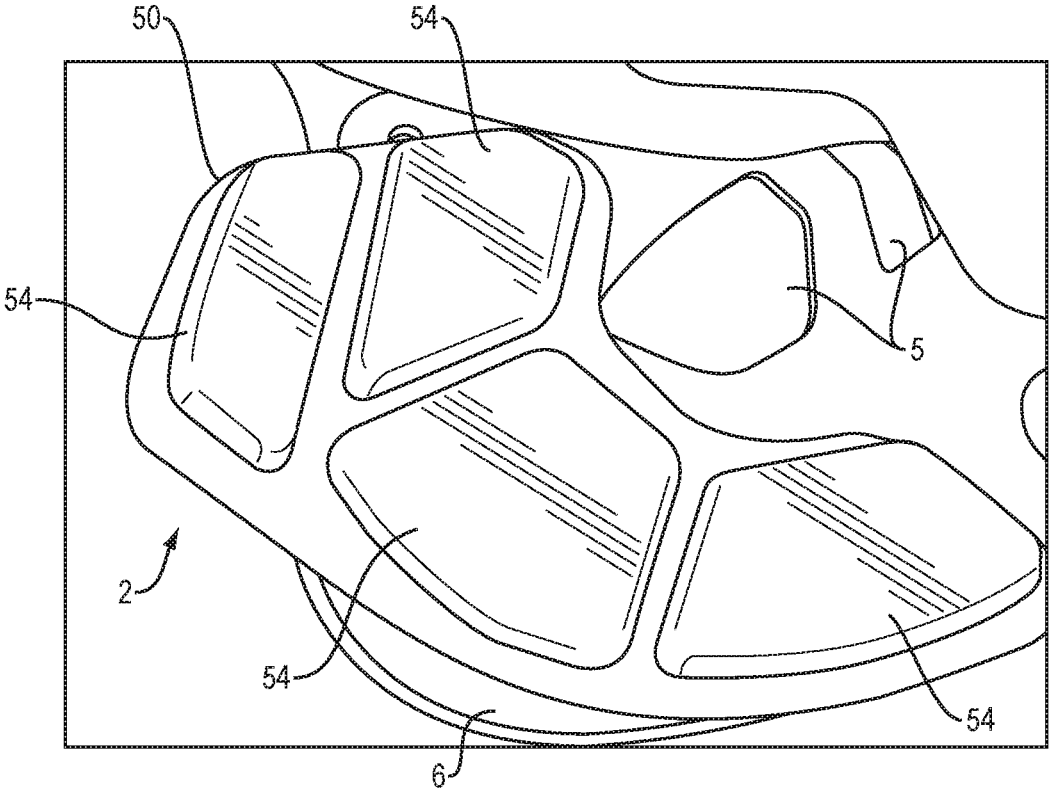
FIG. 2 is a view of the inside of the right earflap of a football helmet having cheek supports according to an embodiment of the subject technology.
Figure 3:
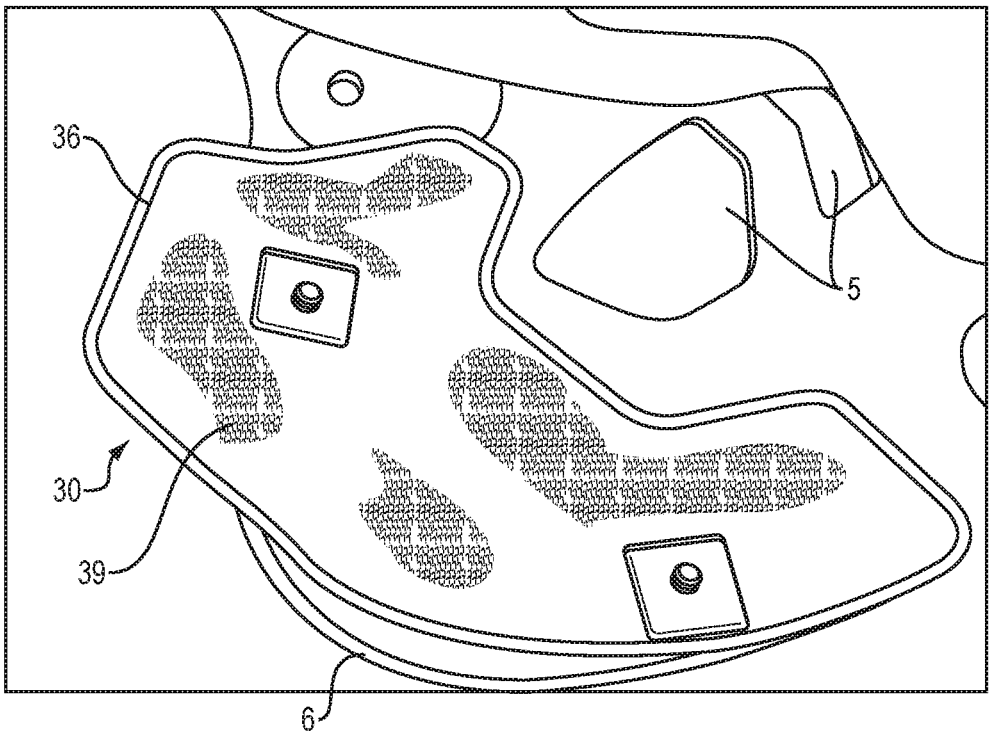
FIG. 3 is a view of the inside of the right earflap of a football helmet having cheek supports according to an embodiment of the subject technology, with the cheek pad removed to reveal the placement of the inner plate.
Figure 4:
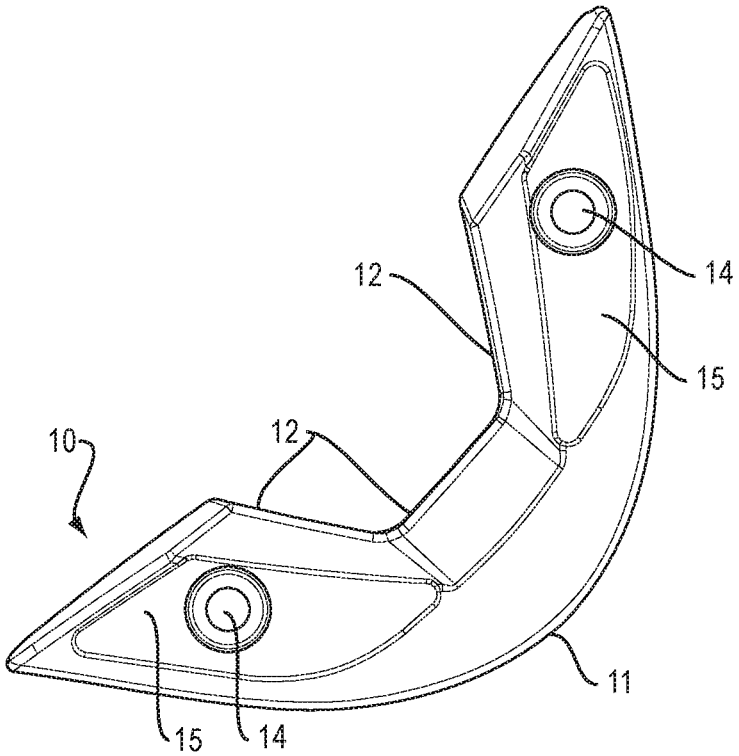
FIG. 4 is a view of the outer face of an outer brace according to an embodiment of the subject technology.
Figure 6:
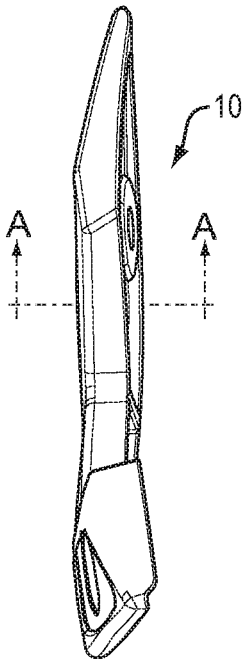
FIG. 6 is a side view of an outer brace according to an embodiment of the subject technology.
Figure 5:
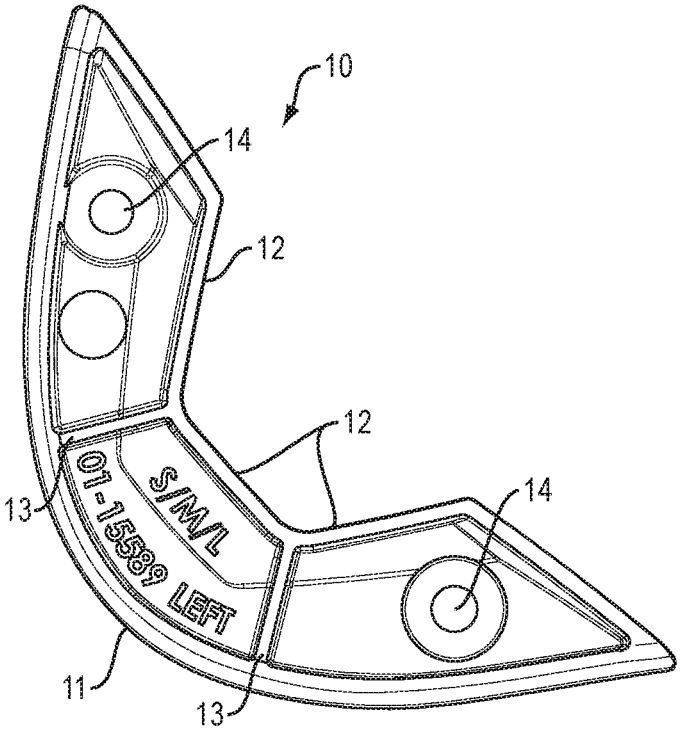
FIG. 5 is a view of the inner face of an outer brace according to an embodiment of the subject technology.
Figure 7:
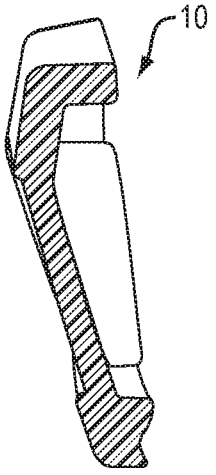
FIG. 7 is a cross-sectional view of an outer brace according to an embodiment of the subject technology, along the line A-A of FIG. 6.
Figure 8:
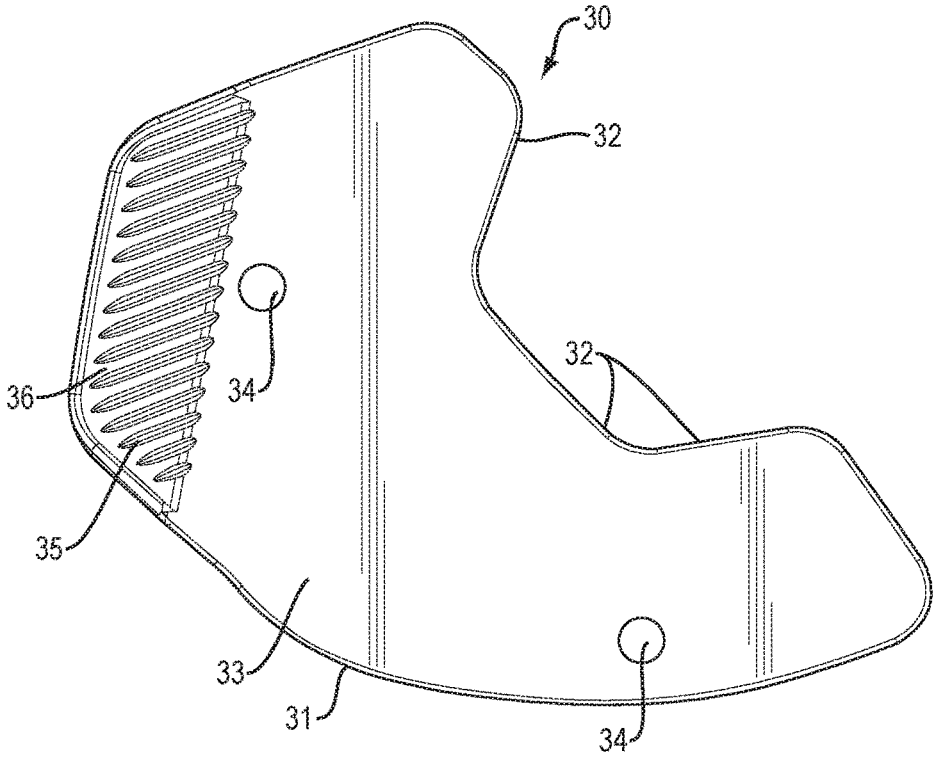
FIG. 8 is a view of the outer face of an inner plate according to an embodiment of the subject technology.
Figure 9:
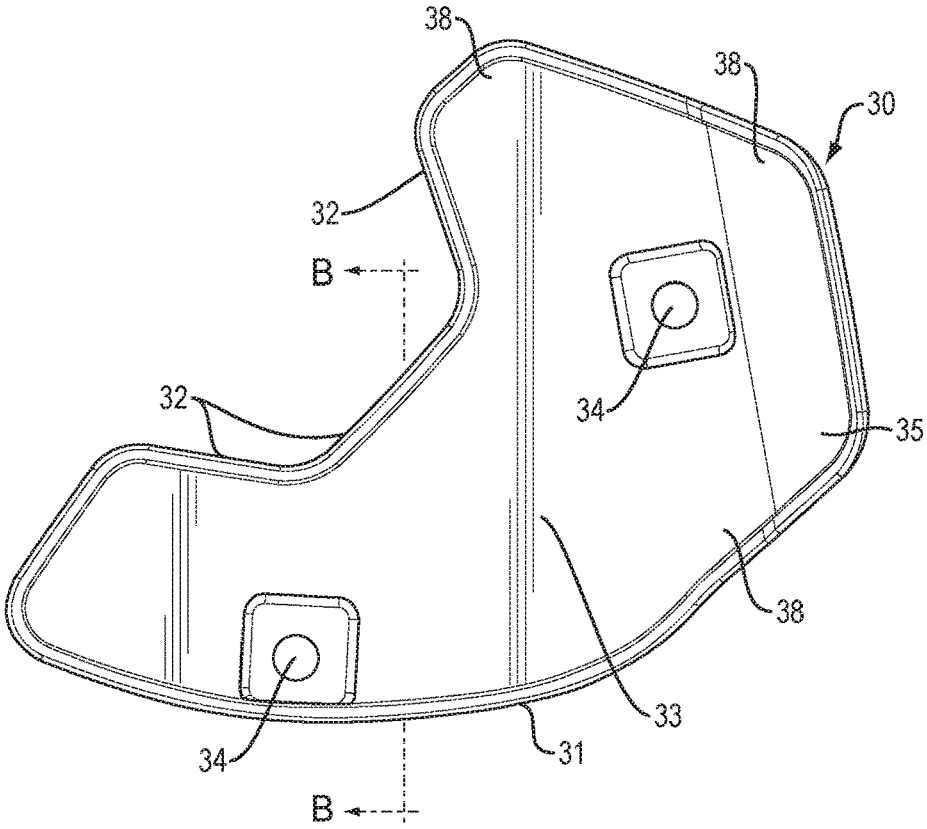
FIG. 9 is a view of the inner face of an inner plate according to an embodiment of the subject technology.

Referring to FIGS. 1A, 1B, 2 and 3, a football helmet 1 with cheek supports 2 according to the subject technology comprises a shell 3 made of molded rigid plastic suitable for use in helmet applications, for example, polycarbonate, ABS plastic, or thermoplastic composite material. Shell 3 has a front region, a rear region, a left side region, and a right side region. Shell 3 includes earflaps 4 overlying the wearer's ears and having earholes therein. Shell 3 may have one or two earholes in each ear flap. In FIGS. 1A and 1B, a shell 3 with two earholes 5, 5' in each ear flap is shown. In the embodiment of FIGS. 1A and 1B, earhole 5' is crescent-shaped and earhole 5 is positioned in front of and within the concavity of earhole 5'. More generally, each earflap may have two earholes, one earhole being a convex polygon and the other earhole being a concave polygon.

Each earflap 4 has a curved lower edge 6 and, higher up on the shell, a front edge 7. Cheek supports 2 as hereinafter described are removably attached to the earflaps 4. Each earflap 4 has two through-going holes 8 for fastening cheek supports 2. Shell 3 includes snap fasteners (unnumbered) for attachment of a removable chinstrap as in known in the art. Shell 3 includes additional through-going holes (unnumbered) for attachment of loopstraps for attachment of a faceguard as in known in the art. Helmet 1 includes replaceable padding liners (not shown) removably attached to the inner surface of the shell as is known in the art.

Figure 12:
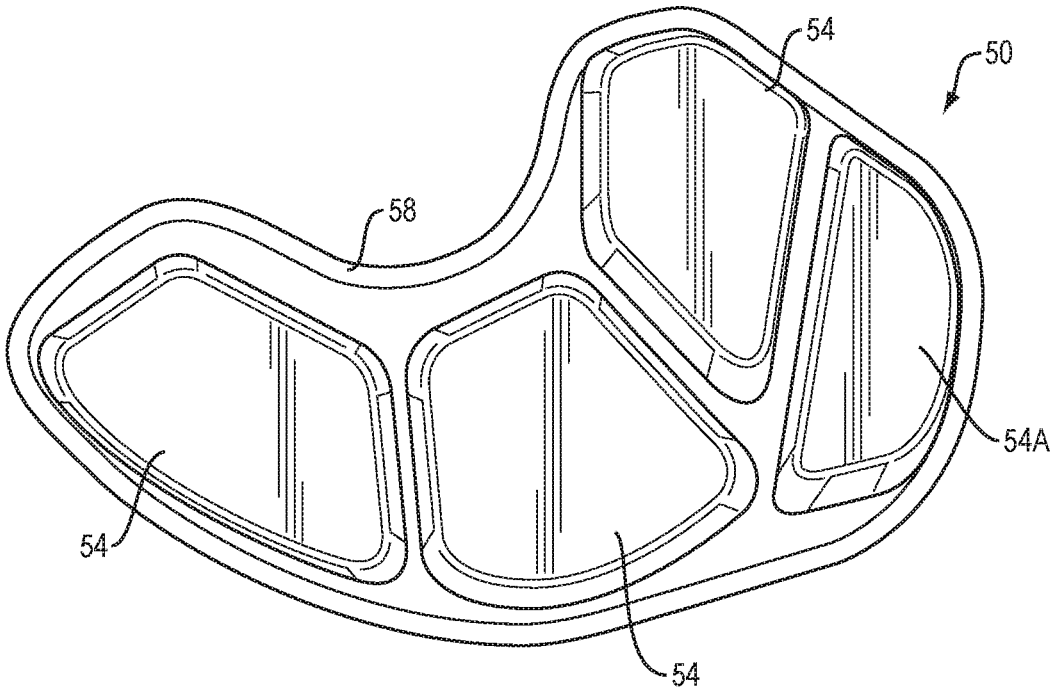
FIG. 12 is a view of a cheek pad according to an embodiment of the subject technology.
Figure 13:
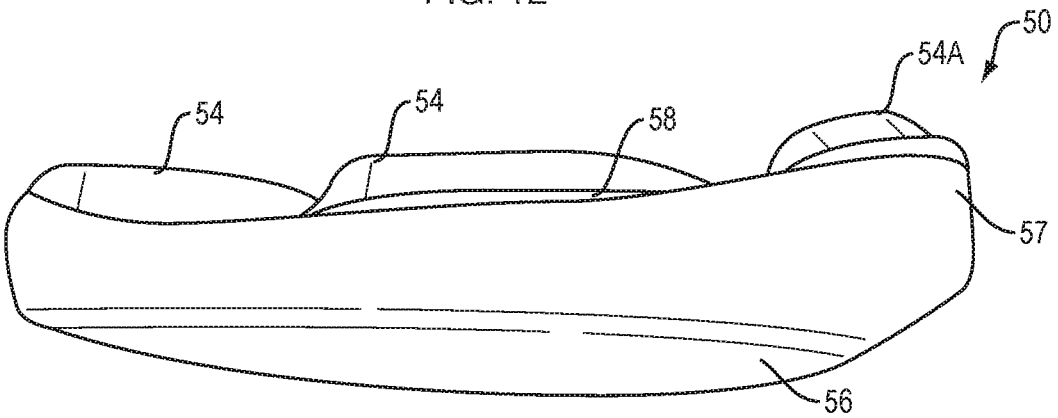
FIG. 13 is a side view of a cheek pad according to an embodiment of the subject technology.
Figure 14:
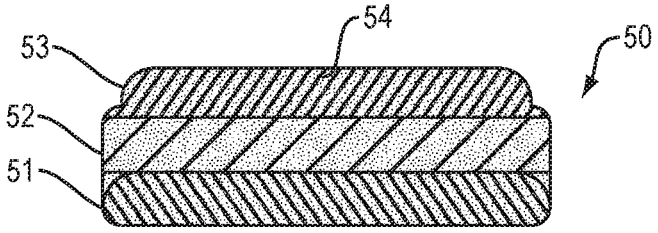
FIG. 14 is a cross sectional view of the layers of a cheek pad according to an embodiment of the subject technology.
Figure 15:
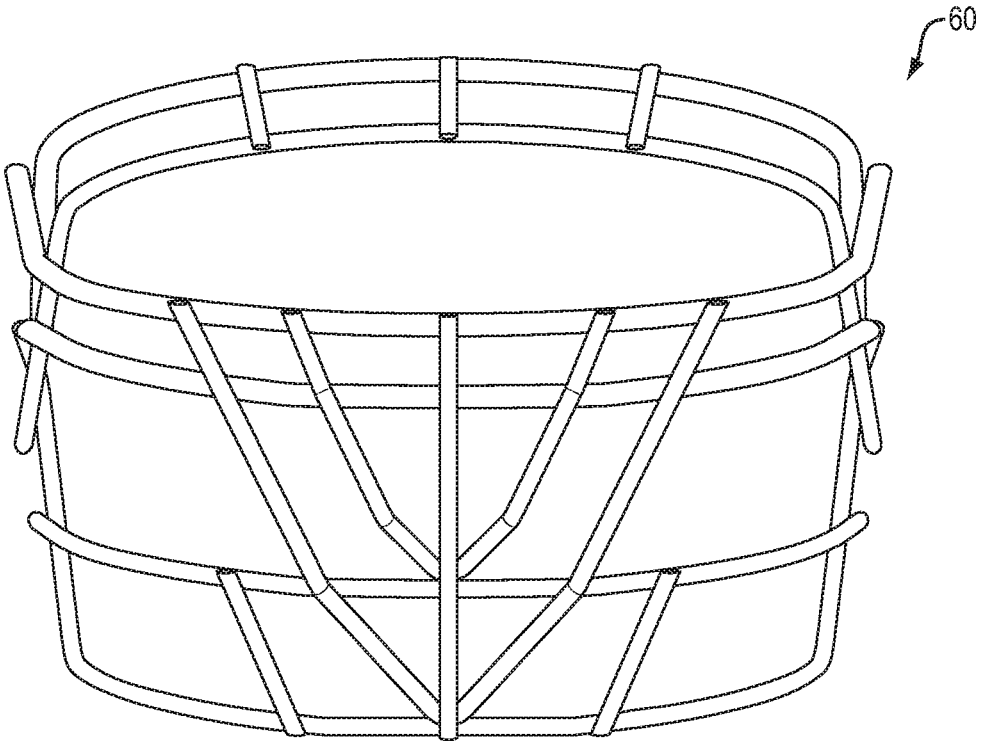
FIG. 15 is a front view of a face guard for a helmet according to an embodiment of the subject technology.
Figure 16:
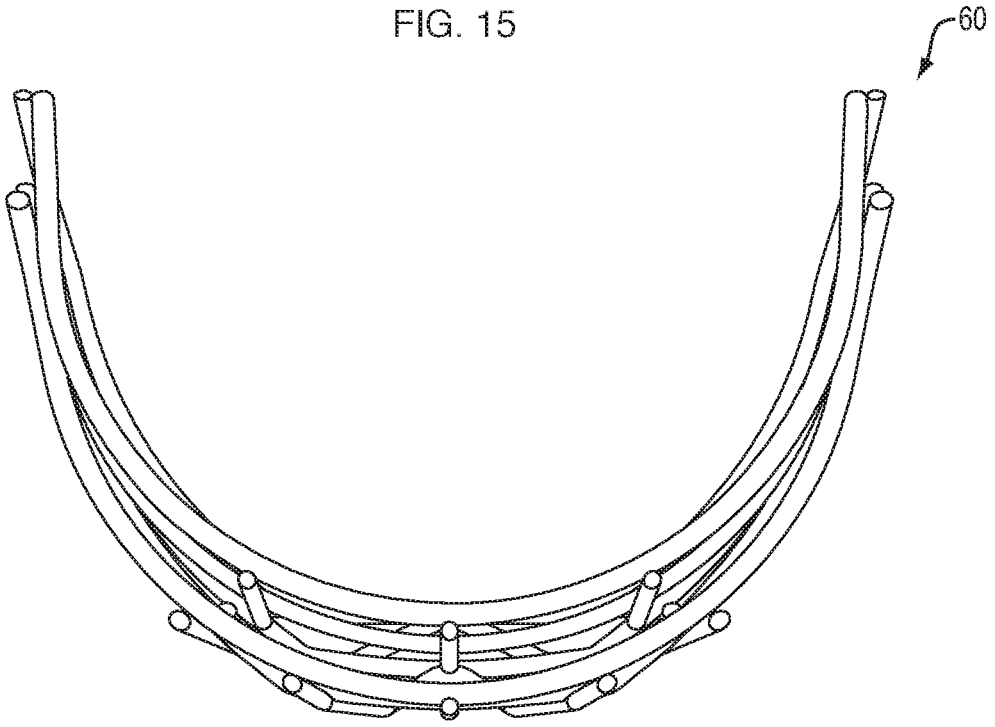
FIG. 16 is a top view of a face guard for a helmet according to an embodiment of the subject technology.
Figure 17:
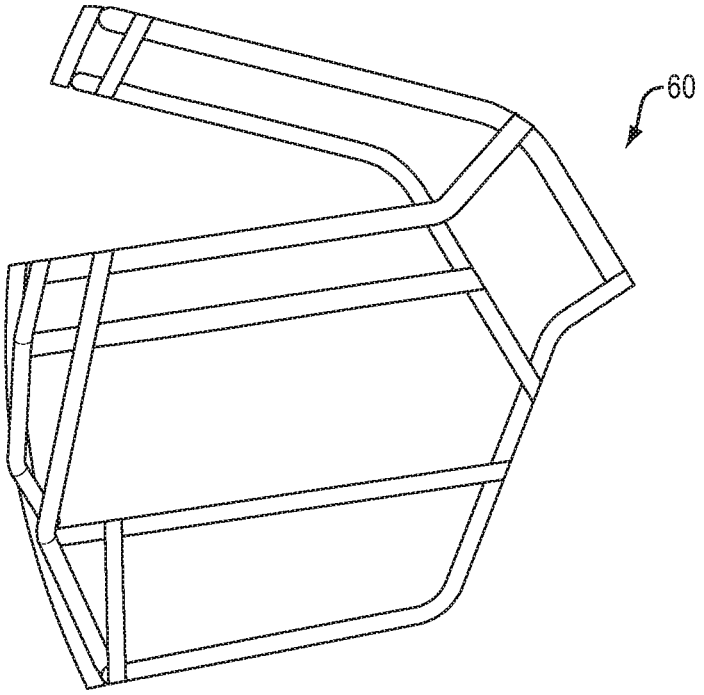
FIG. 17 is a left side view of a face guard for a helmet according to an embodiment of the subject technology.
Figure 18:
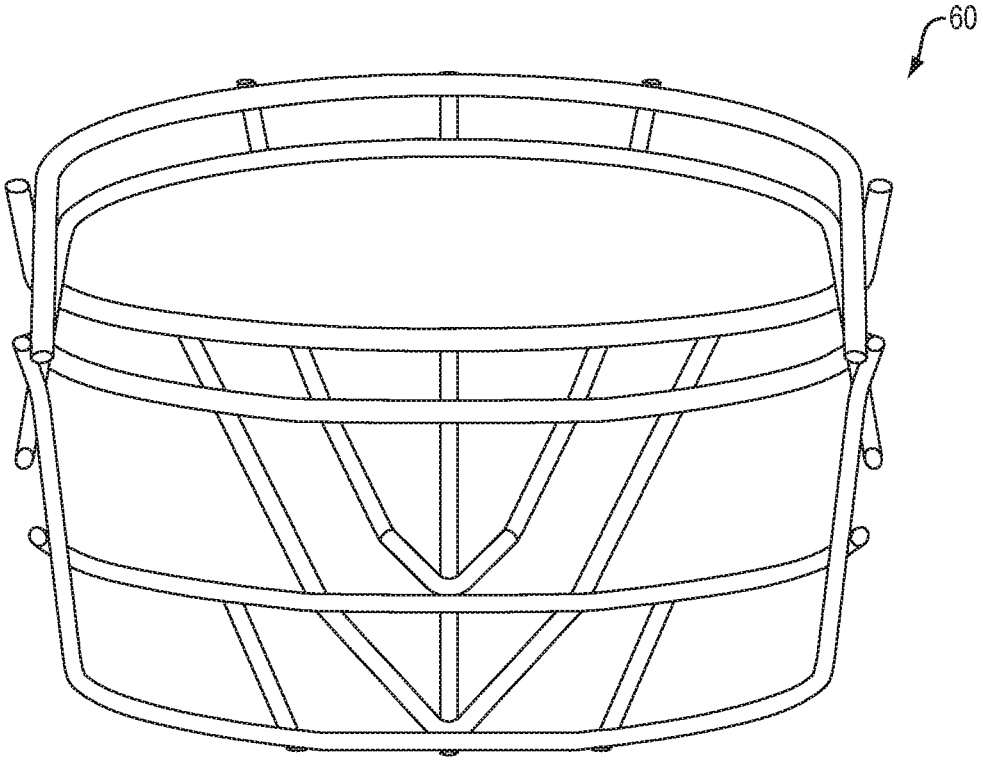
FIG. 18 is a rear view of a face guard for a helmet according to an embodiment of the subject technology.
Figure 19:
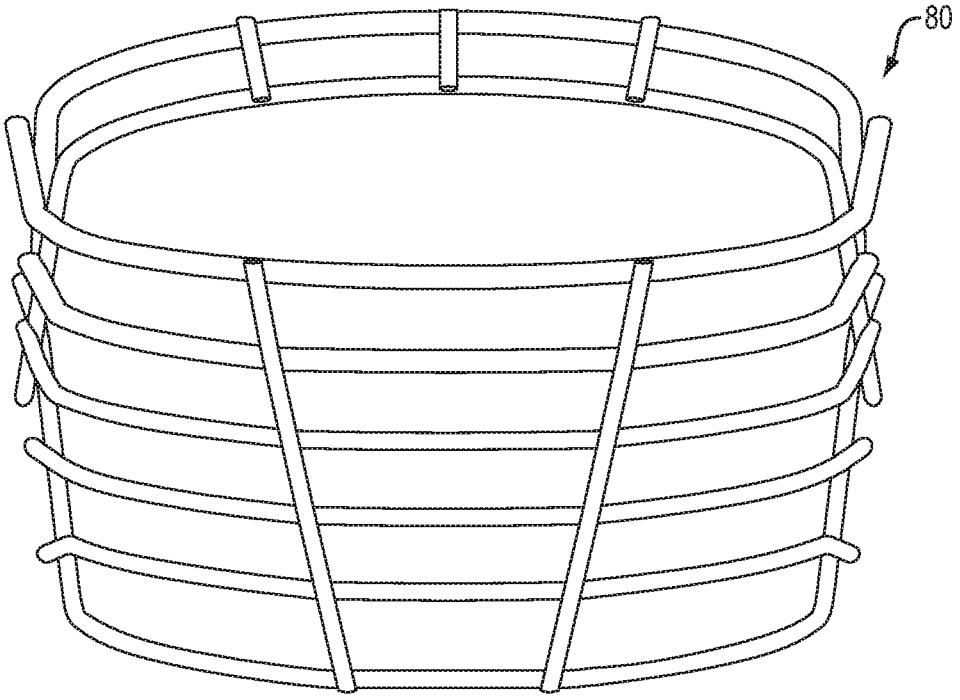
FIG. 19 is a front view of an alternative face guard for a helmet according to an embodiment of the subject technology.
Figure 20:
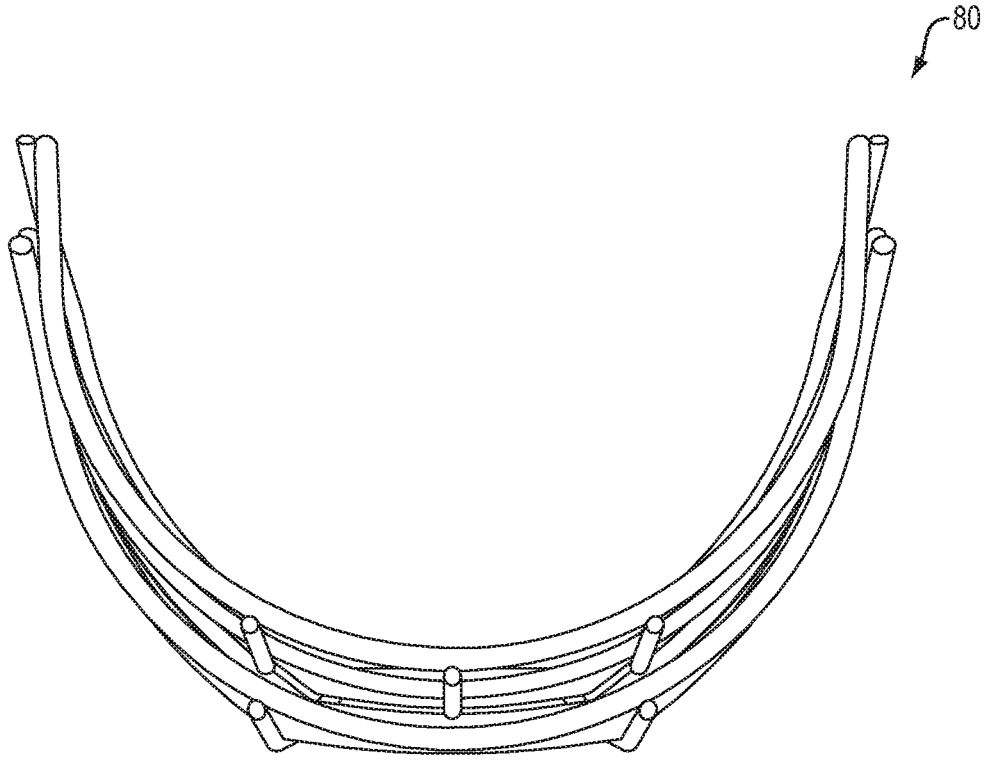
FIG. 20 is a top view of an alternative face guard for a helmet according to an embodiment of the subject technology.
Figure 21:
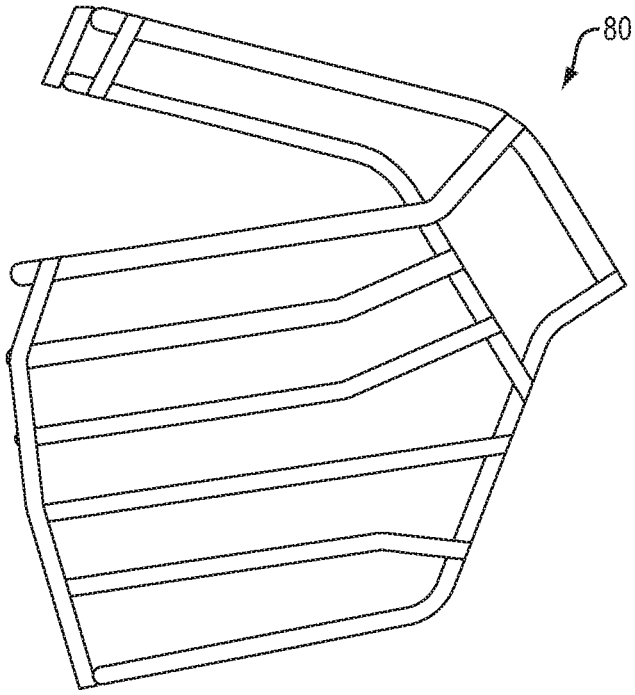
FIG. 21 is a left side view of an alternative face guard for a helmet according to an embodiment of the subject technology.
Figure 22:
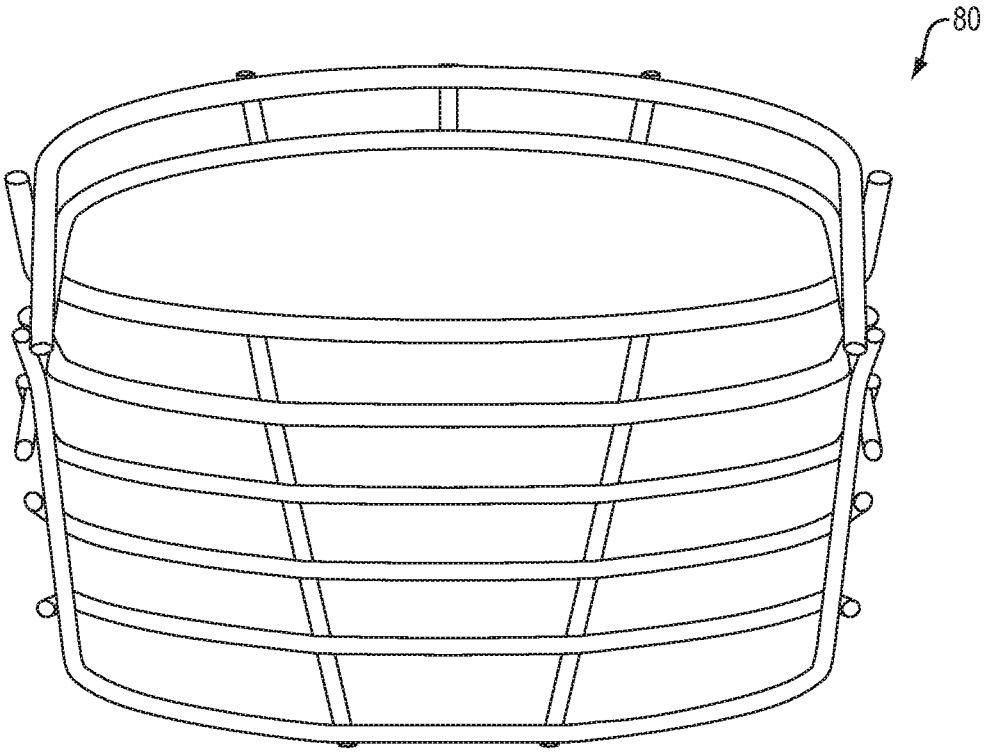
FIG. 22 is a rear view of an alternative face guard for a helmet according to an embodiment of the subject technology.

Each cheek support 2 is comprised of three parts, an outer brace 10 (best seen in FIGS. 4-7), an inner plate 30 (best seen in FIGS. 8-11), and a cheek pad 50 (best seen in FIGS. 12-14). Outer brace 10 is disposed on the outer surface of earflap 4 and inner plate 30 is disposed on the inner surface of earflap 4. Outer brace 10 and inner plate 30 are removably connected to each other and to earflap 4 by two fasteners passing through two through-going holes in the outer brace 10, inner plate 30, and earflap 4. Cheek pad 50 is removably attached to inner plate 30 by, for example, hook-and-loop fasteners.

Referring to FIGS. 4-7, the outer brace 10 of a cheek support 2 is a rigid member made of molded rigid plastic suitable for use in helmet applications, for example, polycarbonate or ABS plastic. The outer brace 10 may be generally U-shaped as in FIGS. 4-7 or could have other shapes such as generally semi-circular. FIGS. 4-7 show an outer brace for attachment to the left earflap of a helmet, it will be understood that an outer brace for attachment to the right earflap of a helmet would be a mirror image of the left outer brace. The outer brace 10 has a lower edge 11 having a contour shaped to follow the contour of the lower edge 6 of the earflap 4. Lower edge 11 preferably does not extend, or does not substantially extend, beyond lower edge 6. The outer brace 10 has an inner edge 12 opposite the lower edge 11 which may be U-shaped to avoid covering or blocking an earhole 5 in the earflap 4. The outer brace 10 may be molded with internal ribs 13 for added strength. The outer brace 10 has two through-going holes 14 for receiving fasteners to fasten the outer brace to the earflap 4 and inner plate 30. The outer brace 10 may be molded with recesses 15 surrounding the holes 14 for receiving labels, caps or a like filler member to obscure the fasteners. The fasteners may be T-nuts and screws, as known in the helmet art.

Figure 10:
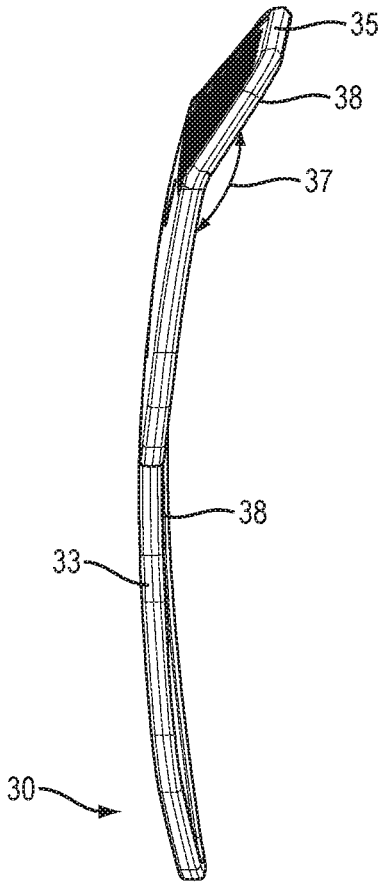
FIG. 10 is a side view of an inner plate according to an embodiment of the subject technology.
Figure 11:
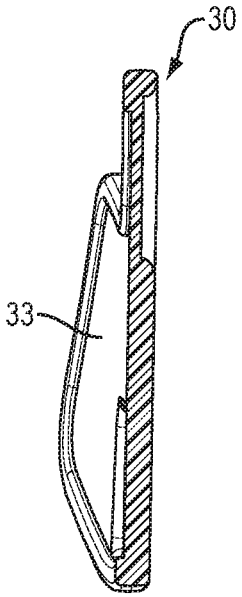
FIG. 11 is a cross-sectional view of an inner plate according to an embodiment of the subject technology, along the line B-B of FIG. 9.

Referring to FIGS. 8-11, the inner plate 30 of a cheek support 2 is a rigid but flexible member made of molded rigid plastic suitable for use in helmet applications in which some flexibility is desired, for example, SURLYN® ethylene copolymer resin. (SURLYN® is a trademark of E. I. du Pont de Nemours and Company.) In an embodiment of the subject technology, the inner plate 30 is made of SURLYN® resin with a hardness of 65 Shore D. The inner plate 30 may have a thickness of 0.08 inches or about 0.08 inches, 0.09 inches or about 0.09 inches, 0.10 inches or about 0.10 inches. The inner plate 30 may have a thickness in the range of 0.08 inches to 0.010 inches. (As used herein "about" shall mean plus or minus 5%.) FIGS. 8-11 show an inner plate for attachment to the left earflap of a helmet, it will be understood that an inner plate for attachment to the right earflap of a helmet would be a mirror image of the left inner plate. The inner plate 30 has a lower edge 31 having a contour shaped to follow the contour of the lower edge 5 of the ear flap 4. Lower edge 31 preferably does not extend, or does not substantially extend, beyond lower edge 6. The inner plate 30 has an inner edge 32 opposite the lower edge 31 which may be U-shaped to avoid covering or blocking an earhole 5 in the earflap 4. As best seen in FIG. 10, the body 33 of the inner plate 30 is curved to match the curvature of the inner surface of the earflap 4. The inner plate 30 has two through-going holes 34 for receiving fasteners to fasten the inner plate 30 to the earflap 4 and outer brace 10. The fasteners may be T-nuts and screws, as known in the helmet art.

The inner plate 30 has an extension 35 integrally formed with the body 33, above the lower edge 31, which is shaped and sized to extend generally beyond the edge of the earflap 4. The extension 35 may be flat or relatively flat, i.e., not curved as the body 33 of the inner plate 30 is curved. The extension 35 may have integrally formed ridges 36 or valleys on its inner surface or outer surface to impart additional stiffness to the extension 35. Advantageously, the extension 35 may extend away from the body of the inner plate at a dihedral angle 37 greater than zero. In an embodiment of the subject technology, dihedral angle 37 may be 20 degrees or about 20 degrees. Alternatively, dihedral angle 37 may be with the range of 15 degrees to 25 degrees. Alternatively, dihedral angle 37 may be with the range of about 15 degrees to about 25 degrees. Alternatively, dihedral angle 37 may be with the range of 0 degrees to 30 degrees. Alternatively, dihedral angle 37 may be with the range of 0 degrees to about 30 degrees.

The inner plate 30 has an inner surface 38, (i.e., the surface facing away from the earflap and toward the wearer). The inner surface 38 may be covered partially, entirely, or substantially entirely by a hook material 39 (best seen in FIG. 3) adhered to the inner surface to serve as an attachment provision for a cheek pad 50, as hereinafter described.

Referring to FIGS. 12-14, the cheek pad 50 of a cheek support 2 is a soft padding construction sized and shaped to correspond substantially to the size and shape of the inner plate 30 and to entirely or substantially overlay inner plate 30. As best seen in FIG. 14, the cheek pad may be constructed of layers 51, 52, 53 of foam material covered with a fabric shell as hereinafter described.

Referring especially to FIG. 14, the base layer 51 of the cheek pad 50 may be comprised of molded foam, such as a relatively stiff foam such as ethylene-vinyl acetate foam. The cheek pad 50 may also comprise an intermediate layer 52 of molded foam, which may be fit foam, memory foam, or a similar foam more yielding than the base layer, such as OMALON®. (OMALON® is a trademark of Carpenter Corporation.) A plurality of inner pads 54, 54A may comprise an inner layer 53 of the cheek pad. The inner pads 54, 54A may be comprised of molded foam such as fit foam, memory foam, or a relatively stiff foam such as ethylene-vinyl acetate foam. Preferably, at least one of pads, 54A in the examples of FIGS. 12 and 13, is disposed to be positioned on the extension 33 of the inner plate 30 when cheek pad 50 is assembled to inner plate 30. In an embodiment of the subject technology, the base layer 51 is comprised of molded ethylene-vinyl acetate foam with a hardness of 45 Shore C, the intermediate layer 52 is comprised of OMALON®, and the inner pads 54 are composed of molded ethylene-vinyl acetate foam with a hardness of 20 Shore C. The intermediate layer may optionally be omitted from the cheek pad. The cheek pad 50 may have an overall thickness of 0.375 inches or approximately 0.375 inches to 1.125 inches or approximately 1.125 inches. The base layer 51 may have a thickness of 0.125 inches or approximately 0.125 inches to 0.25 inches or approximately 0.25 inches. The intermediate layer 52 where present may have a thickness of 0.25 inches or approximately 0.25 inches to 0.5 inches or approximately 0.5 inches The pads 54 of inner layer 53 may have a thickness of 0.175 inches or approximately 0.175 inches to 0.25 inches or approximately 0.25 inches.

The fabric shell may be comprised of a single piece of fabric or a plurality of pieces of fabric as hereinafter described. Stretch fabric such as LYCRA® or a LYCRA®/nylon blend may be used. (LYCRA® is a trademark of E. I. du Pont de Nemours and Company.) Advantageously, the fabric shell may be comprised of three parts, consisting of a loop fabric base 56 for removable attachment to the hook fabric adhered to the inner plate, a base shell 57 of stretch mesh LYCRA®/nylon blend, and an inner shell 58 of LYCRA®. When the fabric shell is comprised of a plurality of pieces of fabric, they may be sewn together to form the overall shell.

The cheek support 2 is assembled to shell 3 by attaching the inner plate 30 and outer brace 10 together by fasteners passing through the previously-described through-holes in the inner plate 30, outer brace 10, and earflap 4. Cheek pad 50 is removably assembled onto the inner surface of the inner plate 30, by for example, loop fabric 56 mating with hook fabric 39.

When helmet 1 is worn by a football player, the cheek pads 50 are held firmly against the wearer's cheek to at least partially overlay the area of the zygomatic bone. The extensions 35 of the inner plates 30 have some flexibility intrinsically and in the area of the dihedral angles 37 so that they may flex somewhat to permit easier donning and removal of the helmet. The cheek pads 50 exert forces bearing against the wearer's cheek area to help retain the helmet 1 on the head during sports play. The padding 50 provided by the cheek pad 2 provides protection to that area against collisions.

Helmet 1 may also have an attached face guard to protect the face during play. FIGS. 15-18 are views of a face guard 60 which may be used in the helmet of the subject technology or other sports helmets. FIGS. 19-22 are views of a alternative face guard 80 which may be used in the helmet of the subject technology or other sports helmets. A faceguard 60 or 80 is comprised of wire members arranged as a grid and is removably attached to the shell 3 with straps and/or other connectors, as is known in the art. For example, face guard 60 or 80 may be removably attached to shell 3 by loop straps connected by screws, nuts, and/or bolts to shell 3 through holes formed therein.

More particularly, faceguard 60 or 80 is a grid of wire members including horizontal wire members and vertical wire members connected together by, for example, welding. The wire members may be composed of steel or titanium. Faceguard 60 or 80 may be coated in a plastic or elastomer layer by, for example, dipping.

Generally, the subject technology includes a football helmet comprising a rigid plastic shell having a left earflap and a right earflap, each of the left and right earflaps having a lower edge and a front edge above the lower edge; two cheek supports, each removably connected to an earflap; each cheek support comprising an outer brace, an inner plate removably connected to the outer brace by fasteners passing through through-going holes formed in the earflap, and a cheek pad attached to the inner plate; the outer brace having a lower edge having a contour shaped to follow a contour of the lower edge of the earflap without extending substantially beyond the lower edge of the earflap; the inner plate having a lower edge having a contour shaped to follow the contour of the lower edge of the earflap without extending substantially beyond the lower edge of the earflap and an extension extending from a body of the inner plate and beyond the front edge of the earflap; and the cheek pad comprising inner pads, at least one of said inner pads positioned to overlay the cheek of a wearer.

It is intended that the foregoing detailed description be regarded as illustrative rather than limiting, and that it be understood that it is the following claims, including all equivalents, that are intended to define the scope of this invention.

What is claimed is:

1. A football helmet comprising:

a plastic football helmet shell, the shell comprising:

a left side region, a right side region, and a rear region;

a left earflap in the left side region and a right earflap in the right side region, each earflap having a non-circular earhole; and an offset area defined on a top edge by a top banked portion and on a bottom edge by a bottom banked portion;

wherein the offset area extends continuously from the right earflap, across the rear region, to the left earflap; and two cheek supports, each removably connected to an earflap.

2. The football helmet of claim 1, wherein each cheek support comprises:

an inner plate having a body and having an extension extending from the body and beyond a front edge of each earflap.

3. The football helmet of claim 2, wherein each inner plate has a dihedral angle defined between the body of the inner plate and the extension of the inner plate, wherein the dihedral angle is in a range of 0 degrees to about 30 degrees.

4. The football helmet of claim 3, wherein the dihedral angle is in a range of about 15 degrees to about 25 degrees.

5. The football helmet of claim 3, wherein the dihedral angle is about 20 degrees.

6. The football helmet of claim 1, wherein the non-circular earholes are in the offset area.

7. The football helmet of claim 1, wherein the top edge curves upward from the right earflap to the rear region and curves upward from the left earflap to the rear region.

8. The football helmet of claim 1, wherein the bottom edge curves upward from the right earflap to the rear region and curves upward from the left earflap to the rear region.

9. The football helmet of claim 1, wherein both the top edge and bottom edge curve upward from the right earflap to the rear region and curve upward from the left earflap to the rear region.

10. The football helmet of claim 1, wherein the top edge and bottom edge do not meet at any point.

11. The football helmet of claim 1, wherein the offset area begins at an open right end in the right earflap and ends at an open left end in the left earflap.

12. The football helmet of claim 1, further comprising a second non-circular earhole in each earflap.

13. The football helmet of claim 12, wherein the second non-circular earholes are in the offset area.

14. The football helmet of claim 2, wherein each cheek support further comprises a cheek pad attached to the inner plate.

15. The football helmet of claim 14, wherein the cheek pad is removably attached to the inner plate.

16. The football helmet of claim 14, wherein the cheek pad comprises one or more inner pads.

17. The football helmet of claim 16, wherein the cheek pad comprises:

a base layer; and an inner layer comprising the one or more inner pads.

18. The football helmet of claim 16, wherein at least one of the one or more inner pads is positioned on the extension of the inner plate.

19. The football helmet of claim 16, wherein at least one of the one or more inner pads is positioned to overlay a cheek of a wearer.

20. The football helmet of claim 2, wherein:
each cheek support further comprises an outer brace; and
the inner plate is removably connected to the outer brace.

* * * * *